United States Patent [19]

Oba

[11] Patent Number: 4,685,436

[45] Date of Patent: Aug. 11, 1987

[54] FUEL INJECTION CONTROL DEVICE FOR INTERNAL COMBUSTION ENGINE

[75] Inventor: Hidehiro Oba, Nagakute, Japan

[73] Assignee: Toyota Jidosha Kabushiki Kaisha, Aichi, Japan

[21] Appl. No.: 889,463

[22] Filed: Jul. 25, 1986

[30] Foreign Application Priority Data

Aug. 8, 1985 [JP] Japan ..... 60-174690

[51] Int. Cl.[4] ..... F02D 41/10

[52] U.S. Cl. ..... 123/492; 123/487

[58] Field of Search ..... 123/492, 487

[56] References Cited

U.S. PATENT DOCUMENTS 4,159,697 7/1979 Sweet ..... 123/492
4,458,651 7/1984 Inoue et al. ..... 123/492

FOREIGN PATENT DOCUMENTS 58-82041 5/1983 Japan .
59-46343 3/1984 Japan ..... 123/492
59-93935 5/1984 Japan ..... 123/492
59-90768 5/1984 Japan ..... 123/492
60-6043 1/1985 Japan ..... 123/492
60-3458 1/1985 Japan .

*Primary Examiner*—Andrew M. Dolinar
*Attorney, Agent, or Firm*—Cushman, Darby & Cushman

[57] ABSTRACT

A fuel injection control device for an internal combustion engine including a synchronous injection control means for controlling a fuel injection amount synchronously with a signal generated at every predetermined crank angle in the internal combustion engine, and an asynchronous injection control means for controlling the fuel injection amount according to an output signal from means for detecting a time of acceleration. The asynchronous injection control means is operated when a number of engine revolution measuring means counts a value equal to or less than a predetermined number of engine revolutions and a throttle valve angle detection means generates a signal equal to or more than a predetermined throttle valve angle signal.

8 Claims, 7 Drawing Figures

FUEL INJECTION CONTROL DEVICE FOR INTERNAL COMBUSTION ENGINE

BACKGROUND OF THE INVENTION

1. Field of the Invention

The present invention relates to a fuel injection control device for controlling an amount of fuel to be injected at acceleration in an internal combustion engine.

2. Description of the Prior Art

In an electronically controlled fuel injection device for controlling the amount of fuel to be injected from a fuel injector according to an operational condition of the internal combustion engine, computation of the amount of fuel to be injected and control of injection are generally carried out according to a crank angle signal generated synchronously with the rotation of the crank shaft. That is to say, the fuel injection amount meeting an output power to be required by the engine is computed according to an amount of suction air and a rotational speed of the engine, etc. with a period of 360° of a crank angle (360° CA) synchronously with the rotation of the crank shaft. Just after the computation, fuel injection (synchronous injection) is carried out at a predetermined timing synchronous with a signal of the crank angle 360° CA.

Conventionally, in some type of engines when an increased amount of fuel is required at acceleration, for example, the fuel is injected at a timing different from that of the synchronous injection as synchronous with a crank angle position, which is so-called asynchronous injection.

As to control of the asynchronous injection at acceleration, there is described in Japanese Laid-open Patent Publication No. 59-90768 for example that a displacement speed of a throttle valve is computed, and if the result of computation is equal to or more than a fixed value, the asynchronous injection is carried out just after the computation.

However, since the conventional fuel injection control device is designed to carry out the asynchronous fuel injection according to the amount of change in the throttle valve angle every short fixed time, a noise enters a signal of the throttle valve angle to generate an erroneous asynchronous injection signal, resulting in malfunction of the fuel injector.

Further, in case of acceleration from a running operation at a large throttle valve angle, a change in suction air amount with respect to a change in the throttle valve angle is actually relatively small as compared with acceleration from a low-load operational range. However, an excessively increased amount of fuel is sometimes injected according to erroneous asynchronous injection signals to cause overrichness of fuel.

In the case that the engine rotational speed is within a high-speed rotational range, the synchronous injection is carried out with a high density and no asynchronous injection is generally required even at acceleration from the high-speed rotational range. However, the asynchronous injection is actually sometimes carried out to result in an undue increase in fuel.

SUMMARY OF THE INVENTION

It is an object of the present invention to solve the aforementioned problems, and provide a fuel injection control device for an internal combustion engine which may carry out proper asynchronous fuel injection according to an engine operational condition at acceleration from a medium and high load range or from a high-speed rotational range.

Another object of the present invention is to provide a fuel injection control device for an internal combustion engine which may carry out proper acceleration fuel increase for synchronous injection according to an engine operational condition at acceleration from a medium and high load range or from a high-speed rotational range.

In accordance with an aspect of the present invention, there is provided, as shown in FIG. 1, a fuel injection control device for an internal combustion engine including synchronous injection control means for controlling a fuel injection amount synchronously with a signal generated at every predetermined crank angle in said internal combustion engine; asynchronous injection control means for controlling the fuel injection amount according to an output signal from means for detecting a time of acceleration; injector driving means for driving a fuel injector according to output signals from said synchronous injection control means and said asynchronous injection control means; acceleration starting time detection means for detecting an acceleration starting time; number of engine revolution measuring means for measuring number of engine revolutions from the acceleration starting time; throttle valve angle detection means for detecting that a throttle valve angle is equal to or more than a predetermined angle after start of acceleration; and means for operating said asynchronous injection control means when said number of engine revolution measuring means measures a value equal to or less than a predetermined number of engine revolutions and said throttle valve angle detection means generates a signal equal to or more than a predetermined throttle valve angle signal.

According to the above aspect of the present invention, the start of acceleration is first detected by the acceleration starting time detection means. Then, after the acceleration starting time is detected, a throttle valve angle is detected by the throttle valve angle detection means on the basis of the acceleration starting time. Further, after detecting the acceleration starting time, a number of engine revolutions is measured by the number of engine revolution measuring means.

If it is detected that the throttle valve angle is equal to or more than a predetermined angle by the throttle valve angle detection means, and the number of engine revolutions from the acceleration starting time as measured by the number of engine revolution measuring means is equal to or less than a predetermined value, the injector driving means is driven by the asynchronous injection control means.

The asynchronous injection control means is operated to feed a fuel injection signal through the injector driving means to the fuel injector independently of the synchronous injection control means and asynchronously with the crank angle position, then immediately carries out asynchronous injection, or extends the synchronous injection time by the time of the asynchronous injection in continuation with the synchronous injection.

The number of engine revolution measuring means may comprise a crank angle counter means for counting every fixed crank angle from the time acceleration starts.

Further, the acceleration starting time detection means may comprise means for detecting switching of an idle switch from ON to OFF. Alternately, the acceleration starting time detection means may comprise means for computing displacement speed of a throttle valve and deciding the acceleration starting time if the computed result is not less than a fixed value and previous result is not more than the fixed value.

In accordance with another aspect of the present invention, there is provided, as shown in FIG. 2, a fuel injection control device for an internal combustion engine including synchronous injection control means for controlling a fuel injection amount synchronously with a signal generated at every predetermined crank angle in said internal combustion engine; injector driving means for driving a fuel injector according to output signals from said synchronous injection control means; acceleration starting time detection means for detecting when acceleration starts; number of engine revolution measuring means for measuring number of engine revolutions from the time acceleration starts; throttle valve angle detection means for detecting that a throttle valve angle is equal to or more than a predetermined angle after acceleration starts; and means for setting an initial value of acceleration fuel increase for said synchronous injection control means when said number of engine revolution measuring means measures a value equal to or less than a predetermined engine revolutions and said throttle valve angle detection means generates a signal equal to or more than a predetermined throttle valve angle signal.

The above and other objects, features and advantages of the present invention and the manner of attaining them will become more clearly apparent, and the invention itself will best be understood, from the following description of a preferred embodiment taken in connection with the accompanying drawings.

PREFERRED EMBODIMENT OF THE INVENTION

There will be now described preferred embodiments of the present invention with reference to the drawings.

Figure 1:
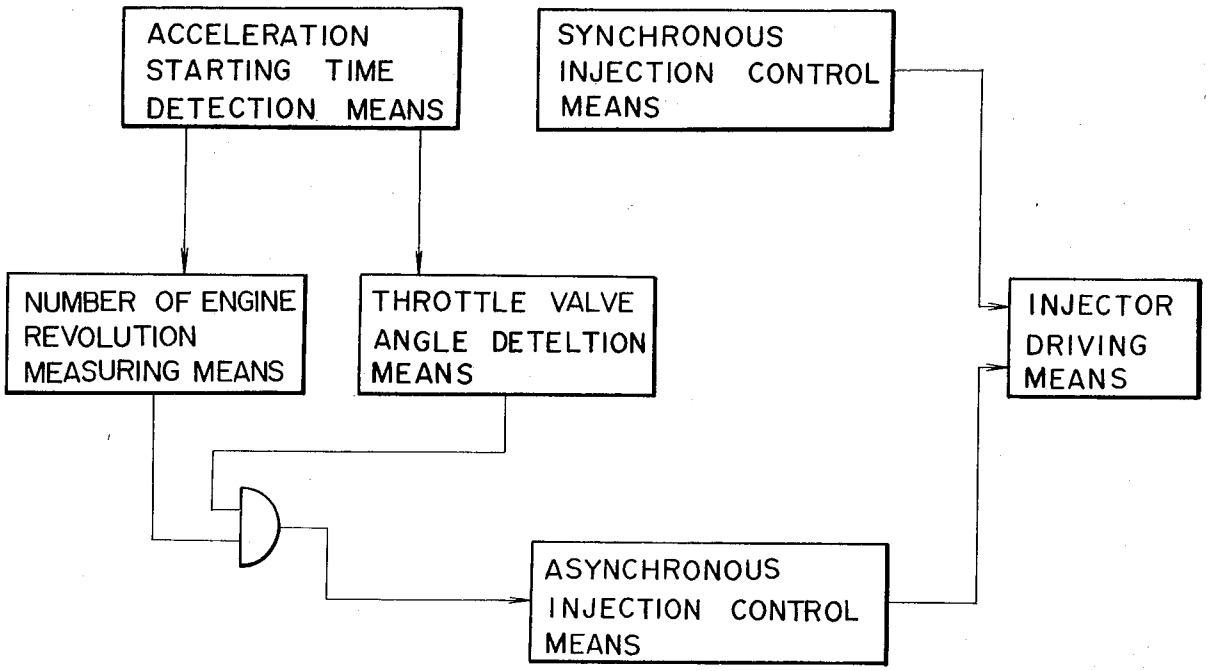
FIG. 1 is a schematic diagram of the fundamental arrangement of the present invention.
Figure 2:
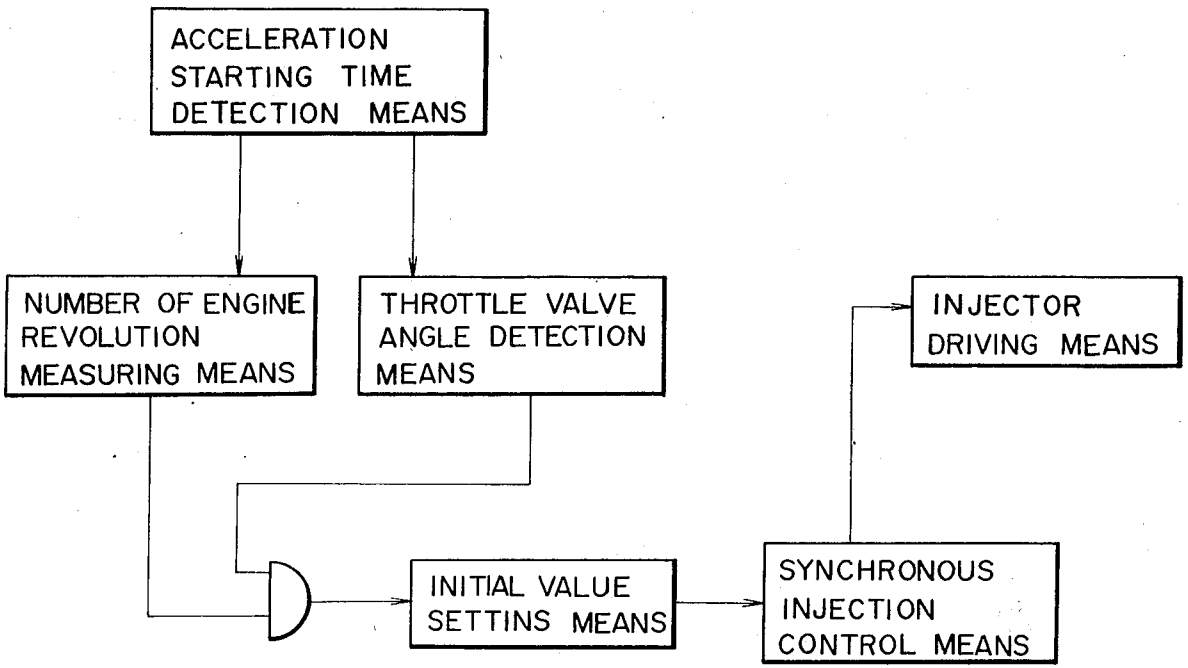
FIG. 2 is a schematic diagram of the fundamental arrangement of another aspect of the present invention.
Figure 3:
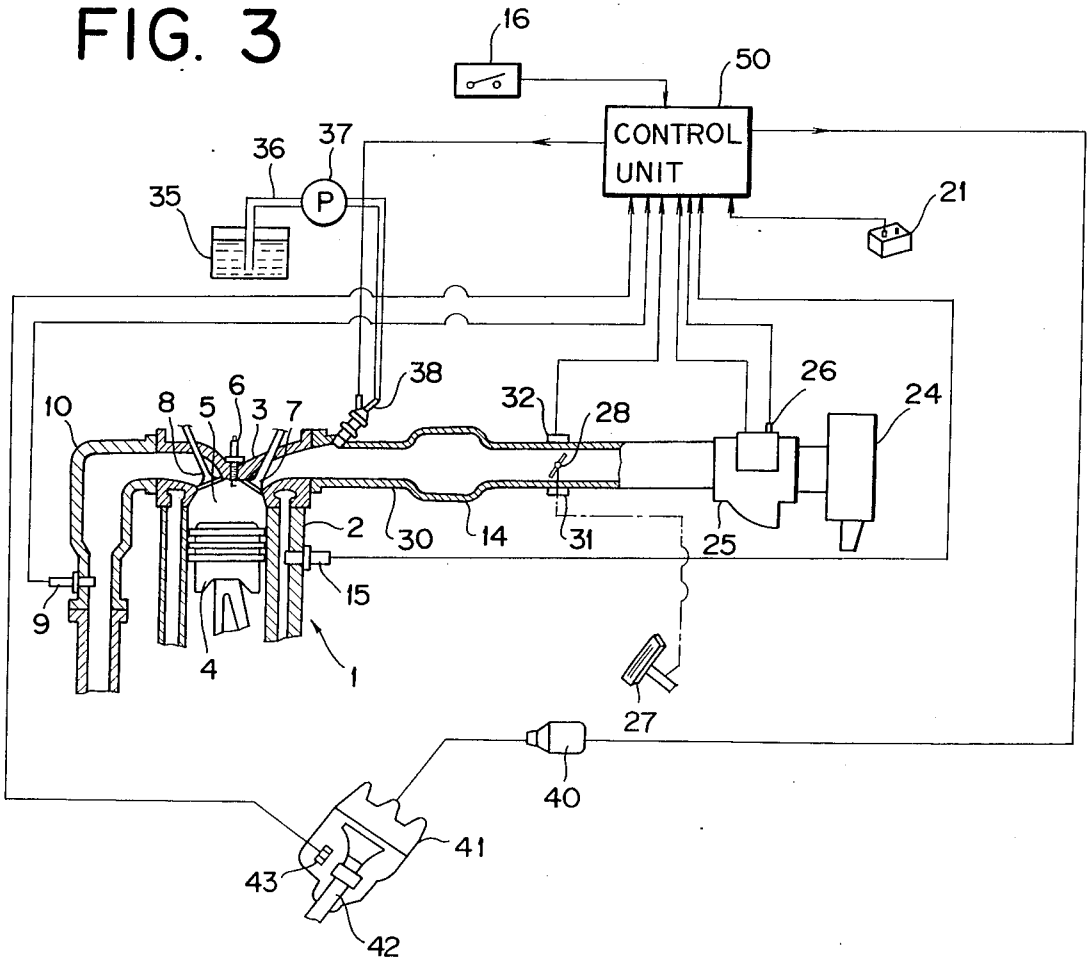
FIG. 3 is a schematic illustration showing an internal combustion engine with a preferred embodiment of the fuel injection device of the present invention.

FIG. 3 shows an exemplary schematic arrangement of an internal combustion engine employing a fuel injection control device according to the present invention.

There are shown in FIG. 3 an internal combustion engine body 1, cylinder block 2, cylinder head 3, piston 4, combustion chamber 5, ignition plug 6, suction valve 7, exhaust valve 8, oxygen sensor 9 for detecting a concentration of oxygen in an exhaust gas in an exhaust manifold 10, coolant temperature sensor 15 for measuring a coolant temperature, ignition switch 16 and battery power supply 21.

A suction system is designed in such a manner that an amount of suction air inducted from an air cleaner 24 is measured by an air flow meter 25, and temperature of the suction air is measured by a suction air temperature sensor 26, and a predetermined amount of the suction air is supplied through a throttle valve 28 adapted to be opened and closed according to an amount of depression of an accelerator pedal 27 to an intake manifold 30. The throttle valve 28 is installed in a throttle body 31, which is provided with a throttle sensor 32 for detecting an opening angle and a full closed position of the throttle valve 28. Further, there is provided in the vicinity of the suction valve 7 in the intake manifold 30 a fuel injector 38 for injecting a predetermined amount of fuel to be fed under pressure from a fuel tank 35 through a passage 36 by a fuel pump 35.

An ignition system is designed in such a manner that a high voltage generated by an ignition coil 40 is supplied to a distributor 41, which acts to control a predetermined ignition timing and simultaneously distribute the high voltage to the ignition plug 6 of each cylinder at a predetermined timing. The distributor 41 is provided with a number of engine revolution sensor 43 for detecting a rotational angle and number of engine revolutions from a rotational position of a distributor shaft 42 synchronously rotating with a crank shaft (not shown). In a preferred embodiment, the number of engine revolution sensor 43 is designed to generate twenty four pulse signals every two rotations of the crank shaft and generate one pulse signal at a predetermined angle every single rotation of the crank shaft.

Figure 4:
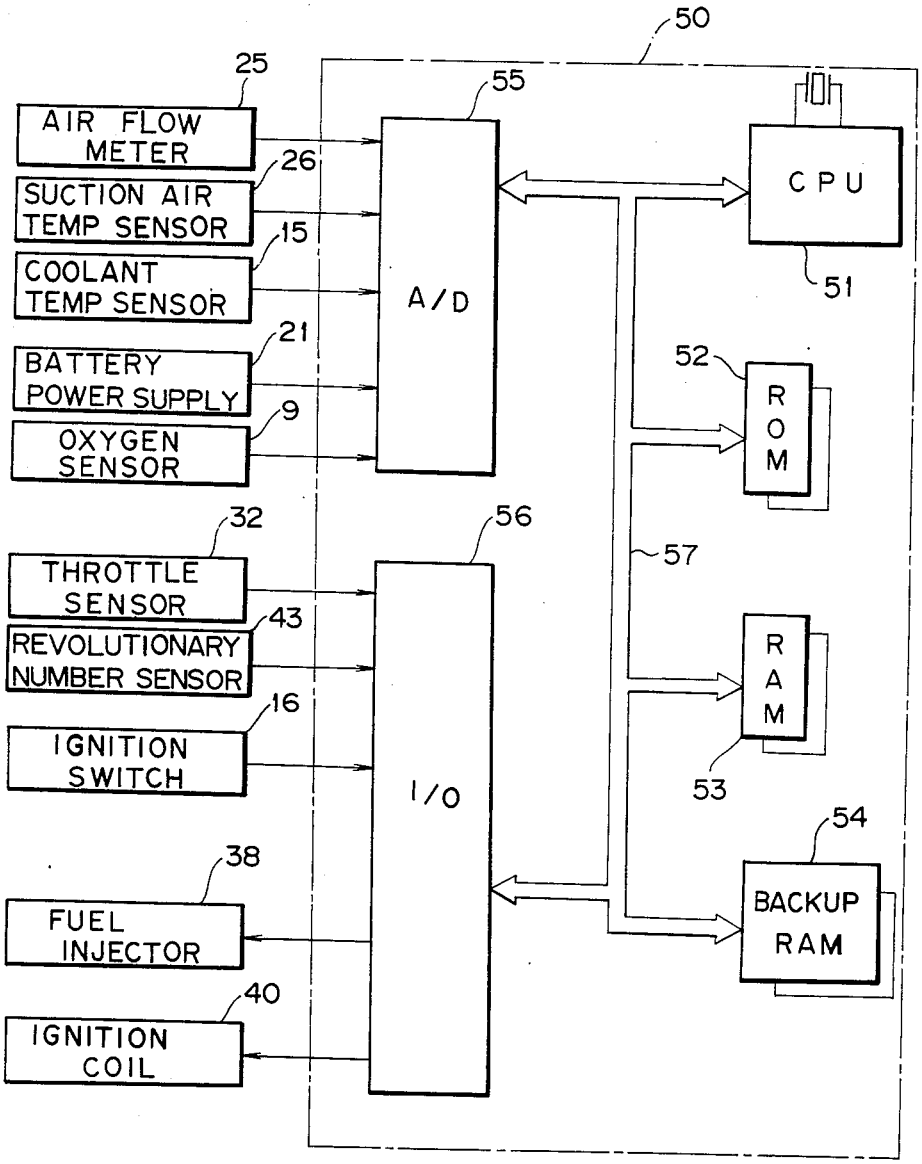
FIG. 4 is a block diagram of a control unit employed in the fuel injection device of the present invention.

A control unit 50 may be a microcomputer adapted to be operated by the battery power supply 21. As shown in FIG. 4, the microcomputer incorporates a central processing unit (CPU) 51, read-only memory (ROM) 52, random access memory (RAM) 53 and backup random access memory (RAM) 54 for retaining a memory during an off state of the ignition switch 16. The ROM 52 stores programs such as a main routine, fuel injection amount control routine and ignition timing control routine, and various fixed data, constants, ect. as required for processing the programs. The microcomputer further incorporates an A/D converter 55 having a multiplexer and an I/O device 56 having a buffer memory. Both the devices 55 and 56 are connected with the devices 51 to 54 by means of a common bus 57.

The A/D converter 55 is adapted to receive output signals from each of the air flow meter 25, the suction air temperature sensor 26, etc. through a buffer into the multiplexer therein, and convert these analog data to digital ones. Then, output signals from the A/D converter 55 are applied to the CPU 51 and the RAM 53 or 54 at a predetermined timing in accordance with a command of the CPU 51. Thus, fresh detected data of suction air amount, suction air temperature and coolant temperature, etc. are read in the RAM 53, and these data are stored at a predetermined area of the RAM 53. On the other hand, the I/O device 56 is adapted to receive detection signals from each of the throttle sensor 32, the number of engine revolution sensor 43, etc., and apply these data to the CPU 51 and the RAM 53 or 54 at a predetermined timing in accordance with a command of the CPU 51.

The CPU 51 acts to calculate an amount of fuel to be injected on the basis of the data as detected by each of the sensor according to the program stored in the ROM 52, and apply a pulse signal based on the calculation through the I/O device 56 to the fuel injector 38. That is to say, fundamentally, a fundamental fuel amount is calculated according to the suction air amount detected by the air flow meter 25 and the number of engine revolutions detected by the number of engine revolution sensor 43, and is corrected according to the suction air temperature and the coolant temperature as detected. Then, a pulse signal corresponding to the corrected fuel amount is supplied from a driving circuit (not shown) in the I/O device 56 to the fuel injection 38.

Figure 5:
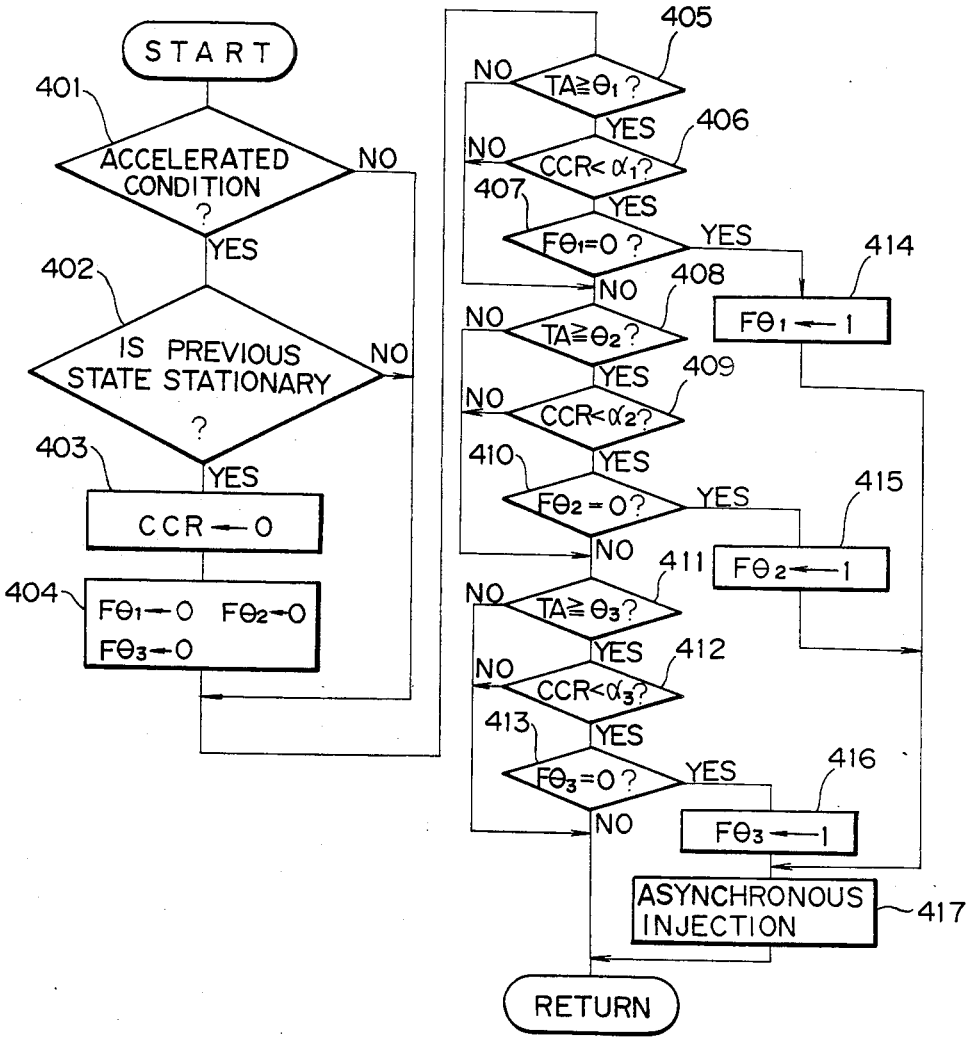
FIG. 5 is a flow chart showing a routine for every fixed time of asynchronous fuel injection at acceleration.
Figure 6:
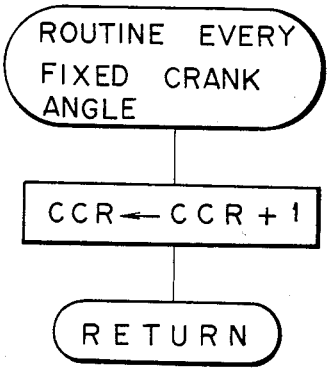
FIG. 6 is a flow chart showing a routine at every fixed crank angle.

There will be next described one example of fuel injection control by the control unit 50 according to the present invention as taken with reference to a flow chart shown in FIGS. 5 and 6.

FIG. 5 shows a routine for every fixed time of asynchronous fuel injection control at acceleration. The routine is executed every fixed time as measured by a timer in a main routine. First, at steps 401 and 402, the start of acceleration of the engine is detected. The acceleration starting time detection means detects the start of acceleration when an idle switch of the throttle sensor 32 is switched from ON to OFF, for example. That is to say, if the idle switch is OFF in the step 401, it is decided that the engine is under the accelerated condition. In the next step 402, if the idle switch is ON in the previous decision, and it is decided that the engine is under a stationary condition (at idling), the acceleration starting time is detected.

In modification, the acceleration starting time detection means may compute displacement speed of a throttle valve and decide the acceleration starting time if the computed result is not less than a fixed value and the previous computed result is not more than a fixed value.

Figure 7:
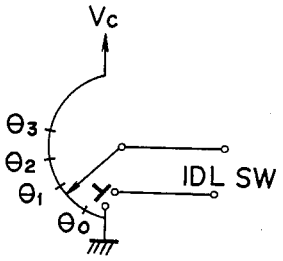
FIG. 7 is a schematic illustration showing a specified throttle valve angle upon execution of asynchronous injection at acceleration in the preferred embodiment of the present invention.

Upon decision of the acceleration starting time, a crank angle counter CCR is cleared at step 403. Then, at step 404, asynchronous injection execution completion flags $F\theta_1$, $F\theta_2$ and $F\theta_3$ are cleared or reset, where in $\theta_i$ ($i=1, 2, 3$) represents a throttle valve angle as shown in FIG. 7. For example, $\theta$ is 80° at full open state of the throttle valve and $\theta_0$, $\theta_1$, $\theta_2$ and $\theta_3$ are set to about 5°, 15°, 25° and 35°, respectively.

When the crank angle counter CCR and the asynchronous injection execution completion flags $F\theta_1$, $F\theta_2$, and $F\theta_3$ are cleared at the acceleration starting time, the routine proceeds from the step 404 to step 405. In the step 405, it is decided whether or not the throttle valve angle TA is equal to or greater than the predetermined throttle valve angle $\theta_1$. If $TA \geqq \theta_1$ is decided, the routine proceeds to step 406. In the step 406, it is decided whether or not the crank angle counter CCR cleared in the step 403 counts less than a predetermined rotational angle $\alpha_1$ after start of acceleration. In case of acceleration from the idling condition, $CCR<\alpha_1$ is generally satisfied at a timing just after acceleration, and the routine proceeds to step 407. In the step 407, it is decided whether or not the asynchronous injection execution completion flag $F\theta_1$ is cleared. If $F\theta_1=0$ is decided, the routine proceeds to step 414. In the step 414, the asynchronous injection execution completion flag $F\theta_1$ at the throttle valve angle $\theta_1$ is set, and then the routine proceeds to step 417, where asynchronous injection is once executed. In this case, if not during synchronous injection, the asynchronous injection is immediately executed, while if during synchronous injection, an injection time is extended by the time of the asynchronous injection.

If the asynchronous injection execution completion flag $F\theta_1$ is set in the step 407, the routine proceeds to step 408, where it is decided whether or not the throttle valve angle TA is equal to or more than a predetermined throttle valve angle $\theta_2$. If $TA \geqq \theta_2$ is decided, the routine proceeds to step 409. In step 409, it is decided whether or not the crank angle counter CCR is less than $\alpha_2$. In other words, if the throttle valve angle after acceleration from the idling condition is a relatively large value $TA \geqq \theta_2$, and the crank angle after start of acceleration is a relatively small value $CCR<\alpha_2$, the routine proceeds from the step 409 to step 410, where it is decided whether or not the asynchronous injection execution coxpletion flag $F\theta_2$ is cleared. If $F\theta_2=0$ is decided, the routine proceeds to step 415, where the asynchronous injection execution completion flag $F\theta_2$ is set, then proceeding to step 417, where asynchronous injection at the throttle valve angle $\theta_2$ is once executed. Accordingly, if the throttle valve angle is a relatively large value $TA \geqq \theta_2$ after acceleration from the idling conditon, and the engine is in operation at relatively low speeds, asynchronous injections at the throttle valve angle $\theta_1$ and $\theta_2$ are twice executed. Thus, the amount of fuel to be injected asynchronously is relatively increased with an increase in acceleration speed.

When the routine proceeds from step 410 to step 411, it is decided whether or not the throttle valve angle TA is equal to or more than the predetermined throttle valve angle $\theta_3$ in the step 411. If it is decided that $TA \geqq \theta_3$, the routine proceeds to step 412, where it is decided whether or not the crank angle counter CCR is less than $\alpha_3$. If $CCR<\alpha_3$ is decided in the step 412, the routine proceeds to step 413, where it is decided whether or not the asynchronous injection execution completion flag $F\theta_3$ is cleared. If $F\theta_3=0$ is decided, the routine proceeds to step 416, where the asynchronous injection execution completion flag $F\theta_3$ is set, then proceeding to step 417, where ashynchronous injection at the throttle valve angle $\theta_3$ is executed. The aforementioned values $\alpha_1$, $\alpha_2$ and $\alpha_3$ are set to about 360, 720 and 1080(°CA), respectively.

The routine as shown in FIG. 5 is executed every fixed time by a timer (not shown), and as far as the throttle valve angle $TA \geqq \theta_i$ after start of acceleration and the crank angle counter $CCR<\alpha_i$ are satisfied, the routine from the steps 405 to 417 is executed. In other words, it is decided whether or not the throttle valve angle TA just after start of acceleration is equal to or more than the predetermined angle $\theta_i$ as stepwise set, and further it is decided whether or not the crank angle counter CCR is less than the predetermined angle $\alpha_i$ at the respective throttle valve anlge $\theta_i$. If these conditions are satisfied at the respective steps, asynchronous injection is once executed at each of the throttle valve angle $\theta_1$, $\theta_2$ and $\theta_3$. In addition, the routine as shown in FIG. 5 is repeatedly executed every fixed time as measured by a timer not shown.

FIG. 6 shows a routine executed at every fixed crank angle, which routine is used in the steps 403, 406, 409 and 412 in FIG. 5. The routine counts up every crank angle of 30° CA.

While the above-mentioned embodiment is adapted in the case of acceleration from an idling condition, there will be next described asynchronous injection at acceleration from an off idling condition.

Detection of start of acceleration under the off idling condition may be attained by measuring the throttle valve angle TA every fixed time, for example. If the throttle valve angles TA every fixed time are $TA_i$ and $TA_{i-1}$, for example, an amount of change in the throttle valve angle $TA_i$-$TA_{i-1}$ every fixed time is calculated, and if $TA_i$-$TA_{i-1}>L_1$ (constant angle), the start of acceleration is decided.

When the throttle valve angle TA is shifted from the operating position of $\theta_1<TA<\theta_2$ to the full open position, start of acceleration is detected in the steps 401 and 402 in the routine as shown in FIG. 5. Then, the routine proceeds to the step 403, where the crank angle counter CCR is cleared, and in the step 404, the asynchronous injection execution completion flags $F\theta_2$ and $F\theta_3$ at the throttle valve angles greater than the throttle valve angle TA ($<\theta_2$) under the initial condition are cleared. The asynchronous injection execution completion flag $F\theta_1$ is not cleared because the throttle valve angle TA under the initial condition is greater than $\theta_1$.

In this case, as $F\theta_1\neq 0$ is given after the start of acceleration, step 404 goes to the steps 405 and 406. If $CCR<\alpha_1$ is decided, the routine proceeds to step 407 and then to step 408. That is to say, the asynchronous injection at $\theta_1$ is not carried out. On the contrary, if $CCR>\alpha_1$ is decided in step 406, the routine proceeds to step 408.

Then, step 408 goes to the step 409, and it is decided whether or not the crank angle counter CCR is less than the crank angle $\alpha_2$ in step 409. If $CCR<\alpha_2$ is decided, the routine proceeds to step 410, and if $F\theta_2=0$ is decided in step 410, the routine proceeds to step 415, where the asynchronous injection execution completion flag $F\theta_2$ is set. Then, the asynchronous injection is once executed in step 417. Then, step 411 goes to step 412, and if $CCR<\alpha_3$ is decided in step 412, the routine proceeds to step 413, where it is decided whether or not $F\theta_3=0$. If $F\theta_3=0$, the routine proceeds to step 416, where the asynchronous injection execution completion flag $F\theta_3$ is set. Then, proceeding to step 417, the asynchronous injection is once executed.

At high speed rotation of the engine, since the crank angle counter CCR reaches the predetermined crank angle $\alpha_i$ in a relatively short time after the crank angle counter is cleared in the step 403, the steps 406, 409 and 412 are hard to go to the steps 407, 410 and 413, respectively. As a result, there are created circumstances where the routine is hard to proceed to the asynchronous injection in the step 417.

In this manner, the asynchronous injection at acceleration from a large throttle valve angle is set to be carried out to a less extent as compared with the asynchronous injection at acceleration from a small throttle valve angle. This is due to the fact that a change in the amount of suction air with respect to the throttle valve angle is relatively small under the operational condition of a large throttle valve angle, so as to avoid an undue increased amount of fuel by the asynchronous injection.

Further, while the crank angle counter CCR is cleared in step 403 after detecting the timing of start of acceleration in the high speed rotational range, the crank angle increases in a relatively short time, and accordingly it is hard to reach $CCR<\alpha_1$ in step 406, 409 and 412. As a result, the routine is almost returned to the start without carrying out the asynchronous injection to much extent.

Although in the above embodiment, asynchronous injection is executed in step 417, this step may be modified to set an initial value of an acceleration fuel increase for synchronous injection in the case that an engine has no asynchronous injection mechanisum. In this modified embodiment, after setting an initial value of an acceleration fuel increase for synchronous injection, the initial value will be decreased every fixed time or every fixed crank angle by another routine programmed in the control unit 50, which is well known in the art.

In the aforementioned embodiment, the acceleration starting time detection means is designed to detect the acceleration starting time when the idle switch is selected from ON to OFF, or when the displacement speed of the throttle valve is not less than a predetermined value. However, the acceleration starting time may be adopted in the following cases:

(a) When $TA_j$-$TA_{j-1}>L_2$ (constant) is detected when using the throttle valve angle TA at every fixed crank angle.

(b) When a present throttle valve position is different from a previous throttle valve position in the case of checking the throttle valve positions with the routine for every fixed time on the basis of the specified throttle valve angles $\theta_0$, $\theta_1$, $\theta_2$ and $\theta_3$ in FIG. 7. For example, when the previous throttle valve position falls between $\theta_0$ and $\theta_1$ and the present throttle valve position falls between $\theta_1$ and $\theta_2$.

(c) When $Q/Ni-Q/N_{i-1}>L_3$ (constant) is detected when using an engine load Q/N (suction air amount-/number of engine revolutions).

(d) When $PM_i$- $PM_{i-1}>L_4$ (constant) is detected when using a suction pressre PM.

According to the aforementioned embodiment, the throttle valve angles $\theta_0$, $\theta_1$, $\theta_2$ and $\theta_3$ for execution of asynchronous injection are set every cycle of the routine for every fixed time as shown in FIG. 5, and if the sum of the number of engine revolutions after acceleration is within a predetermined range when the throttle valve angles exceed the specified throttle valve angles, it is designed to carry out the asynchronous injection once at each of the throttle valve angles every fixed time. Further, a time for asynchronous injection is set in such a manner that the amount of fuel to be injected once is proportional to the value of Q/N.

According to the present invention as mentioned above, asynchronous injection or acceleration fuel increase for synchronous injection is carried out when the number of engine revolutions at the specified throttle valve angle on the basis of acceleration detection timings are within a fixed value. Accordingly, it is not necessary to carry out a differential operation which is apt to be influenced by noise in throttle valve angle signals. Even if the differential operation is carried out, it is simply a trigger at the start of the operation, and an asynchronous injection signal or acceleration fuel increase signal for synchronous injection according to an engine operational condition may be securely generated. In particular, it is possible to avoid over-richness of fuel by the amount corresponding to no execution of undue asynchronous injection or no execution of undue acceleration fuel increase for synchronous injection at acceleration from a high load operational range or at acceleration from a high speed rotational range. Furthermore, it is possible to avoid an undue increase in fuel to thereby reduce fuel consumption.

Consequently, it is possible to properly supply fuel according to acceleration operational condition from low-speed low-load operational range to high-speed highload operational range.

While the invention has been described and shown with particular reference to the preferred embodiment, it will be apparent that variations that would fall within the scope of the present invention which is not intended to be limited except as defined in the following claims.

What is claimed is:

1. In a fuel injection control device for an internal combustion engine including synchronous injection control means for controlling a fuel injection amount synchronously with a signal generated at every predetermined crank angle in said internal combustion engine, asynchronous injection control means for controlling the fuel injection amount according to an output signal from means for detecting a time of acceleration, and injector driving means for driving a fuel injector according to output signals from said synchronous injection control means and said asynchronous injection control means; the improvement comprising:

acceleration starting time detection means for detecting an acceleration starting time;

number of engine revolution measuring means for measuring number of engine revolutions from the acceleration starting time;

throttle valve angle detection means for detecting that a throttle valve angle is equal to or more than a predetermined angle after start of acceleration; and means for operating said asynchronous injection control means when said number of engine revolution measuring means measures a value equal to or less than a predetermined number of engine revolutions and said throttle valve angle detection means generates a signal equal to or more than a predetermined throttle valve angle signal.

2. A fuel injection control device according to claim 1 wherein said number of engine revolution measuring means comprises crank angle counter means for counting every fixed crank angle from the acceleration starting time.

3. A fuel injection control device according to claim 1 wherein said acceleration starting time detection means comprises means for detecting switching of an idle switch from ON to OFF.

4. A fuel injection control device according to claim 1 wherein said acceleration starting time detection means comprises means for computing displacement speed of a throttle valve and deciding the acceleration starting time if the computed result is not less than a fixed value and the previous computed result is not more than the fixed value.

5. In a fuel injection control device for an internal combustion engine including synchronous injection control means for contorlling a fuel injection amount synchronously with a signal generated at every predetermined crank angle in said internal combustion engine, and injector driving means for driving a fuel injector according to output signals from said synchronous injection contorl means; the improvement comprising:

acceleration starting time detection means for detecting an acceleration starting time;

number of engine revolution measuring means for measuring number of engine revolutions from the acceleration starting time;

throttle valve angle detection means for detecting that a throttle valve angle is equal to or more than a predetermined angle after start of acceleration; and means for setting an initial value of an acceleration fuel increase for said synchronous injection control means when said number of engine revolution measuring means measures a value equal to or less than a predetermined number of engine revolutions and said throttle valve angle detection means generates a signal equal to or more than a predetermined throttle valve angle signal.

6. A fuel injection control device according to claim 5 wherein said number of engine revolution measuring means comprises crank angle counter means for counting every fixed crank angle from the acceleration starting time.

7. A fuel injection control device according to claim 5 wherein said acceleration starting time detection means comprises means for detecting switching of an idle switch from ON to OFF.

8. A fuel injection control device according to claim 5 wherein said acceleration starting time detection means comprises means for computing desplacement speed of a throttle valve and deciding the acceleration starting time if the computed result is not less than a fixed value and the previous computed result is not more than the fixed value.

* * * * *